United States Patent [19]

Izumida et al.

[11] Patent Number: 4,481,089

[45] Date of Patent: Nov. 6, 1984

[54] METHOD FOR DECONTAMINATING METALS CONTAMINATED WITH RADIOACTIVE SUBSTANCES

[75] Inventors: Tatsuo Izumida, Hitachi; Koji Kato, Matsudo; Fumio Kawamura, Hitachi, all of Japan

[73] Assignees: Hitachi, Ltd.; Hitachi Plant Engineering and Construction Co., Ltd., both of Tokyo, Japan

[21] Appl. No.: 582,543

[22] Filed: Feb. 22, 1984

[30] Foreign Application Priority Data

Feb. 23, 1983 [JP] Japan ..... 58-27703

[51] Int. Cl.[3] ..... C25F 1/00; C25F 3/02; C25F 5/00

[52] U.S. Cl. ..... 204/129.43; 204/129.75; 204/129.95; 204/144.5

[58] Field of Search ..... 204/146, 129.43, 129.75, 204/129.8, 129.95, DIG. 9, 141.5, 144.5, 145 R, 140

[56] References Cited

U.S. PATENT DOCUMENTS

| | | | |
|---|---|---|---|
| 2,468,006 | 4/1949 | Webster | 204/144.5 |
| 3,063,917 | 11/1962 | Barts | 204/144.5 |
| 3,905,885 | 9/1975 | Bengel | 204/129.43 |
| 4,193,853 | 3/1980 | Childs | 204/129.95 |

*Primary Examiner*—Thomas Tufariello

*Attorney, Agent, or Firm*—Antonelli, Terry & Wands

[57] ABSTRACT

The present invention provides a method for decontaminating metal components which have been contaminated on their surfaces with radioactive substances, characterized in that radioactivated oxide films on the metal surfaces are electrolytically removed by an alternating electrolysis method in a neutral salt solution. According to the invention, oxides and hydroxides for metals removed by the electrolytic treatment are separated from the electrolyte and solidified. The method of this invention makes it possible to positively remove the radioactivated oxide films from a base metal.

13 Claims, 7 Drawing Figures

METHOD FOR DECONTAMINATING METALS CONTAMINATED WITH RADIOACTIVE SUBSTANCES

BACKGROUND OF THE INVENTION

This invention relates to a method for decontaminating metal components which have been contaminated on their surfaces with radioactive substances. More particularly, this invention relates to such a decontamination method for radiation contaminated metals, which method is especially suited for the decontamination of the surface-contaminated metal wastes produced in nuclear plants such as nuclear power plants, nuclear fuel concentrator, etc.

Radiation contaminated metal wastes including equipments, apparatus, tools, pipes and such are yielded from nuclear power plants at the time of periodic inspection or various kinds of repairing or reconstruction works. Currently, these radioactive metal wastes are packaged in drums after cut appropriately and stored in the plants. The number of such radioactive waste metal-packaged drums turned out in a year is on the order of 150 to 200, but their cumulative amount is increasing every year. When reactors presently used in the nuclear power plants are scrapped and dismantled, which is expected in not the distant future, the amount of the radioactive metal waste alone would reach several ten thousands of drums. It is therefore strongly desired to make an effort for remarkably reducing the radiation contaminated metal components by safely decontaminating them.

SUMMARY OF THE INVENTION

An object of this invention is to provide a decontamination method for metals contaminated with radioactive substances, which method is capable of drastically reducing the radiation contaminated metal components in nuclear plants or other institutions.

Another object of this invention is to provide a radiation contaminated metal decontamination method which is capable of effectively removing radioactivated stiff spinel type oxide films ($Fe_3O_4$) in radiation contaminated metal components by an electrolytic means.

Still another object of this invention is to provide a radiation contaminated metal decontamination method capable of separating from the electrolyte and solidifying the metal elements (including radioisotopes) which have been electrolytically removed from the radiation contaminated metal components.

In order to accomplish said objects, the present invention provides as a feature thereof a method for electrolytically decontaminating metals which have been contaminated on their surfaces with radioactive substances, which comprises subjecting a metal to be decontaminated to an alternating electrolysis treatment consisting of alternately repeated cathode electrolysis in a unit period of 30 to 180 seconds and anode electrolysis in a unit period of 15 to 60 seconds with a ratio of the cathode electrolysis time to the anode electrolysis time of 1 to 4 by using an aqueous solution of a neutral salt as electrolyte, thereby removing the radioactivated oxide films and metal surfaces.

The present invention also provides as a second feature thereof a method for electrolytically decontaminating metals which have been contaminated on their surfaces with radioactive substances, which comprises subjecting a metal to be decontaminated to an alternating electrolysis treatment consisting of alternately repeated cathode electrolysis in a unit period of 30 to 180 seconds and anode electrolysis in a unit period of 15 to 60 seconds with a ratio of the cathode electrolysis time to the anode electrolysis time of 1 to 4 by using an aqueous solution of a neutral salt to thereby remove the radioactivated oxide films and metal surfaces, separating a decontamination residue contained in the electrolyte from the electrolyte, and solidifying the separated residue by adding a solidifying agent thereto.

Other features, objects and advantages of the present invention will become apparent from the following detailed description of the invention when taken in conjunction with the attached drawings.

DESCRIPTION OF PREFERRED EMBODIMENTS

Figure 1:
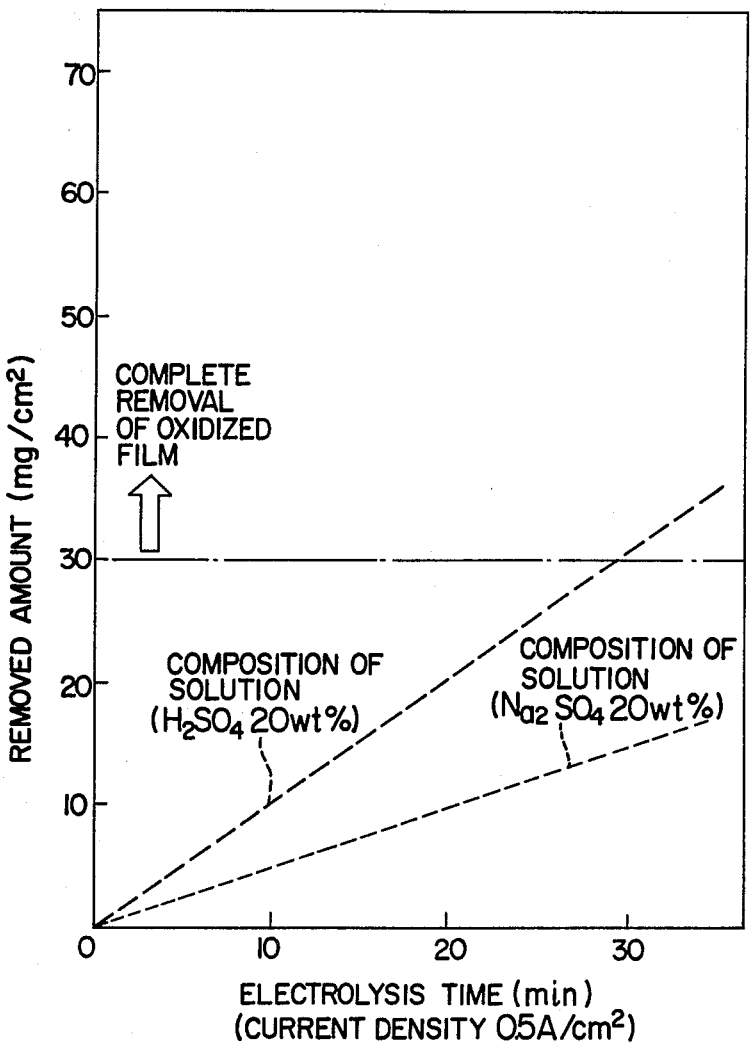
FIG. 1 is a graph showing the relation between an electrolysis time and a removed amount of oxide films.

Radiation contaminated metal wastes can be roughly classified into two groups: tools and their sorts brought in from the outside for works in the plants, and equipments and devices (including component parts) installed in the plants. The former are contaminated on their surfaces when radioactive isotopes released from the devices adhere to the tool surfaces during the works or at the time of periodic inspection. Contamination of the latter occurs when oxides deposited on a reactor core (such oxides being mainly composed of iron and called "crud") are radioactivated by neutron bombardment and such radioactivated crud is carried to the devices in the primary cooling system and main vapor system to accumulate on the surfaces of such devices, or the radioactivated metal elements penetrate into the oxide films on the device surfaces. The latter overwhelm the former in quantity. The amount of the latter type of waste comes to around 30–50 tons at the time of periodic inspections conducted every year, and its figure could reach 20,000 tons at the time of dismantlement of the scrapped reactors.

Decontamination techniques for these surface contaminated metals can be roughly classified into physical methods such as high-speed jet water cleaning, supersonic cleaning, etc., and chemical methods such as pickling, electrolytic decontamination, etc. Tools can easily be decontaminated by a physical method since radioactivated metals are simply deposited on their surfaces. In the case of contaminated devices, radioactivated metals are taken in the oxide films, and such contaminated oxide films cannot be sufficiently removed by a physical method alone, so that the use of a chemical method is required. Even with the chemical methods, however, use of pickling alone takes a long time, and hence is impractical for removing the oxide ($Fe_3O_4$) films having a stiff spinel type crystal structure. But according to the electrolytic decontamination method in which an object to be decontaminated is immersed in an electrolyte while allowing it serve as an anode and an electric current is applied thereto to compulsorily dissolve the anode surface, it is possible to perfectly remove the radioactivated oxide films by a short-time electrolysis treatment under certain specific conditions.

As techniques for decontaminating the radioactivated oxide films or metal surfaces by the electrolysis, there are known a method in which an object to be decontaminated is subjected to an anode electrolysis in a concentrated aqueous solution of a strong acid such as phosphoric acid or sulfuric acid (Japanese Patent Appln Kokai (Laid-Open) No. 140300/81) and a method in which the anode electrolysis is conducted in an aqueous solution of a neutral salt (Japanese Patent Appln Kokai (Laid-Open) No. 76500/82). The method using a strong acid is superior to the neutral salt method in the oxide film and metal surface removing performance, but since the radioactivated metals removed by the electrolysis are dissolved in the strong acid as ions, the treatment of the used acid is complicated to invite a rise of the processing cost and also an increase of secondary waste. In the method using a neutral salt solution, the treatment of waste liquor is easy as the removed oxide films or metals are precipitated in the form of hydroxides. Even with this method, however, it is difficult to remove the oxide films ($Fe_3O_4$) having a stiff spinel structure formed under the environment around the devices in nuclear power plants, that is, under the operating conditions of 270° C. and 70 atm.

In such an electrolytic decontamination method where the object is treated as an anode, the oxide film formed on the object surface is not dissolved per se but the base metal below such oxide film is dissolved so that the oxide film is separated as a consequence. Therefore, this method shows an excellent electrolytic effect in a solution rich in hydrogen ions or halogen ions which can penetrate even into a stiff oxide film, but the oxide film removing ability is very poor in most of the solutions containing neutral salts such as nitrate, sulfate, etc.

FIG. 1 shows the results obtained when a steel plate having an approximately 100 μm thick oxidized film was subjected to an anode electrolysis. It was found that it was necessary to electrolyze the base metal of more than twice the weight of the oxidized film, and in the case of a sodium sulfate solution, polishing of more than one hour was required.

A method for removing weak oxide films by subjecting the object (steel plate) to alternating electrolysis in an aqueous neutral salt solution has been proposed (Japanese Patent Appln Kokai (Laid-Open) No. 120637/78), but such alternating electrolysis method can not applied to the decontamination of radiation contaminated metals. The invention of Japanese Patent Appln Kokai (Laid-Open) No. 120637/78 intends to remove an oxide scale produced in the treating steps such as rolling, annealing, etc., of steel material, and for this purpose, a three-layer ($Fe_2O_3$-$Fe_3O_4$-FeO) weak laminate oxide film formed at a temperature above 500° C. under atmospheric pressure is subjected to mechanical scale breaking and then alternating electrolysis is conducted in a very short time on the thus treated object. On the other hand, radioactive metal wastes produced in nuclear power plants or such are mostly thick-walled (more than 10 mm thick) pipings or valves, and it is difficult to conduct mechanical scale breaking such as rolling on such materials. Further, the above-mentioned radioactive contaminated metal oxide film is so stiff that it cannot be removed by the alternating electrolysis as taught by this Application Kokai No. 120637/78.

In case an object to be decontaminated (contaminated metal) is subjected to an electrolytic treatment by letting said object act as an anode, the base metal below the oxide film is dissolved as said above, but when the same electrolytic treatment is conducted on said object by letting it serve as a cathode, there take place the reduction reactions of the following formulae:

$$Fe_3O_4+6H_2O+e^- \rightarrow 3Fe^{3+}+10\ OH^-+H_2 \quad (1)$$

$$2H_2O+2e^- \rightarrow 2OH^-+H_2 \quad (2)$$

Figure 2:
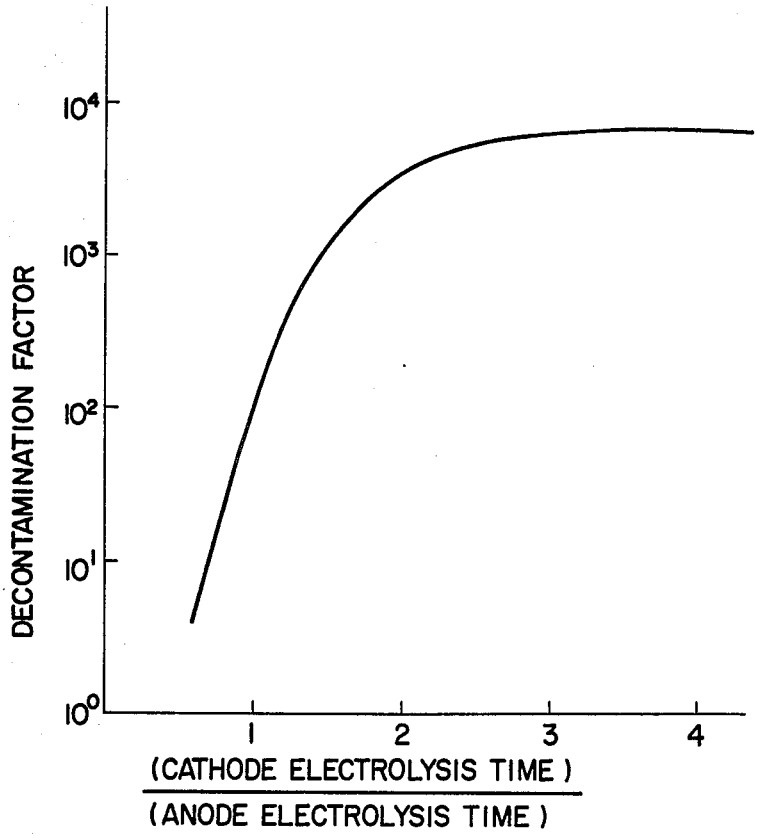
FIG. 2 is a graph showing the relation between a ratio of cathode electrolysis time to anode electrolysis time and a decontamination factor.

By the reaction of the formula (1), the oxide film is reduced and dissolved, but its dissolution rate is very low as shown in FIG. 2, and hence the primary reaction is the decomposition of water expressed by the formula (2). The present inventors, however, have found the fact that the oxide film composed of $Fe_2O_3$ and $Fe_3O_4$ before the cathode electrolysis is reduced by the cathode electrolysis and transmuted into a soft oxide film mainly compose of FeO.

The present invention was achieved on the basis of such finding. According to this invention, a stiff oxide film is first subjected to a cathode reduction to soften the film so that the ions can easily penetrate into the film, and the thus treated film is further subjected to an anode electrolysis, these two steps being repeated alternately to attain effective removal of the oxide film.

In the step of cathode electrolysis, in addition to the reactions of the formulae (1) and (2), an additional reaction represented by the following formula (3) takes place for reducing and softening the oxide film:

$$Fe_3O_4+e^- \rightarrow \text{softening of the film (mainly composed of FeO)} \quad (3)$$

The softened oxide film is increased in its ion penetrability, so that when such an oxide film is subjected to the next step of anode electrolysis, said film is separated with the dissolution of base metal. By repeating this process, it is possible to remove the radioactivated oxide film on base metal by far faster than possible with the known methods.

FIG. 2 shows the decontamination factor (radioactivity before decontamination/radioactivity after decontamination) as obtained when the electrolytic process of this invention was carried out for 20 minutes by changing the ratio of cathode electrolysis time to anode electrolysis time. It is seen from the graph that the best result is obtained when the cathode electrolysis time is prolonged to effect sufficient softening of the oxide film and then anode electrolysis is conducted. However, the decontamination factor lowers when the cathode electrolysis time becomes more than 10 times the anode electrolysis time.

More in detail, the ratio of the cathode electrolysis time to the anode electrolysis time is effective in the range of 1 to 4, and more preferably in the range of 2 to 3. In this connection, the length of each cathode electrolysis time or anode electrolysis time is also important. The anode electrolysis time is preferably 15 to 60 seconds, more preferably 20 to 40 seconds and the best at 30 seconds. The cathode electrolysis time is preferably 30 to 180 seconds, more preferably 40 to 120 seconds, and particularly preferably 60 to 90 seconds. A total time required for the alternating electrolysis (treating time) is preferably 10 to 20 minutes.

Figure 6:
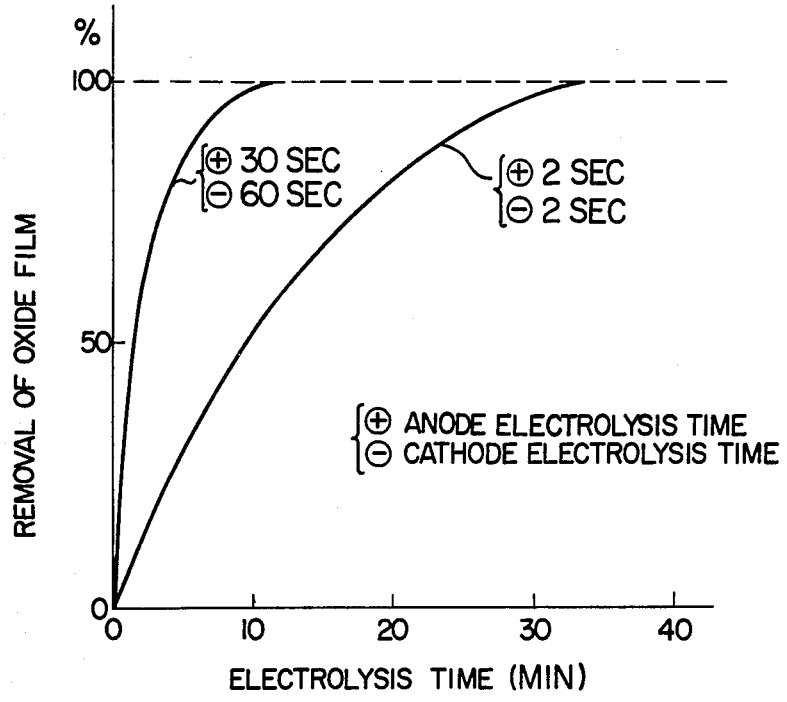
FIG. 6 is a graph showing the relation between a removal percent of oxide film and an electrolysis time when an alternating electrolysis is conducted.

FIG. 6 shows the relationship between the removal percent of oxide film and alternating electrolysis time when the repeated anode electrolysis time and cathode electrolysis time are changed. When the cathode electrolysis time is 2 seconds and the anode electrolysis time is 2 seconds, the alternating electrolysis time of about 35 minutes is necessary for 100% removal of oxide film, although the ratio of each electrolysis time is 1. On the other hand, when the cathode electrolysis time is 60 seconds and the anode electrolysis time is 30 seconds, the alternating electrolysis time of about 12 minutes is necessary for 100% removal of oxide film. The results of FIG. 6 clearly show that the electrolysis time is remarkably reduced by selecting proper unit cathode and anode electrolysis time.

Figure 7:
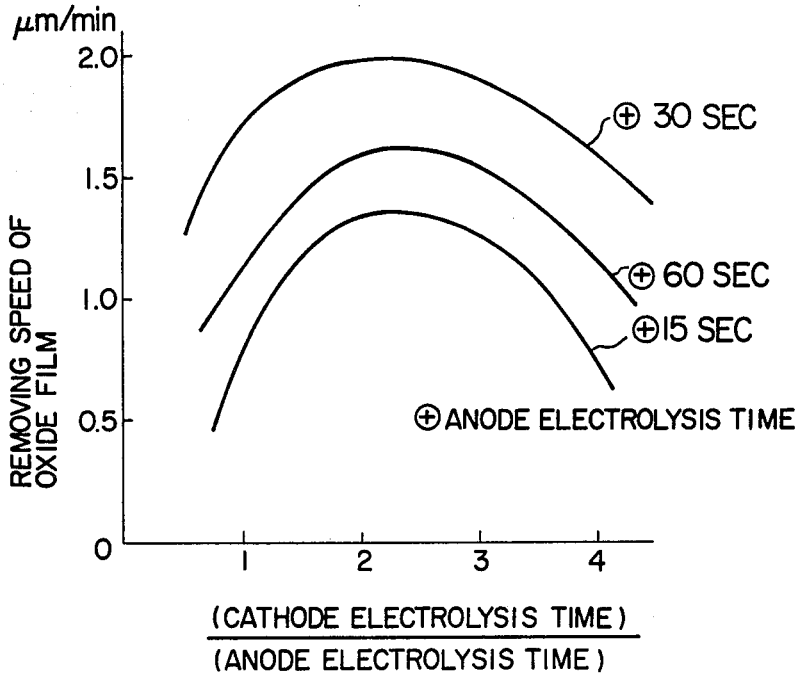
FIG. 7 is a graph showing the relation between a removing speed of oxide film and a ratio of cathode electrolysis time to anode electrolysis time.

The effects of the length of cathode and anode electrolysis times and the ratio thereof on the removing speed of oxide film are shown in FIG. 7. In FIG. 7, only the unit anode electrolysis time is shown in the graph, but the unit cathode electrolysis time can easily be obtained considering the ratio of cathode electrolysis time to anode electrolysis time. As clearly shown in FIG. 7, the best results are obtained when the unit anode electrolysis time is 30 seconds, while the unit periods of 15 and 60 seconds also give good results.

Figure 3:
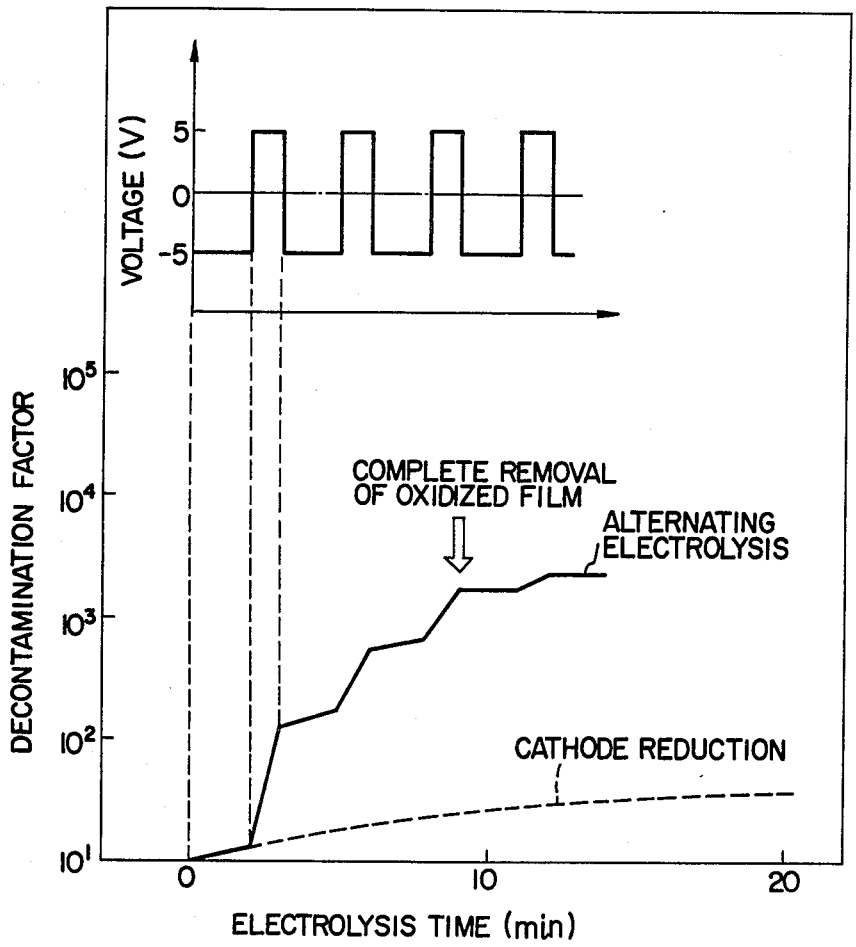
FIG. 3 is a graph showing the relation between an electrolysis time and a decontamination factor.

FIG. 3 shows the results obtained when a carbon steel plate having an approximately 100 μm thick oxide film was subjected to alternating electrolysis in a sodium sulfate solution according to this invention. It will be seen that the film removal amount drastically increases when the film is treated first by cathode electrolysis and then by anode electrolysis, and the film is completely removed by about 10-minute electrolysis. It is possible with this method to decontaminate the object material to the background level of radioactivity by removing 10 mg/cm$^2$ of contaminated metals and oxide films in 10 minutes. According to the known anode electrolysis method as shown in FIG. 1, it is necessary to remove more than about thrice (30 mg/cm$^2$) as much amount of metals and oxide films as in the case of the method of this invention for attaining the same level of decontamination. Thus, the method of this invention can realize a remarkable reduction of secondary waste.

As the neutral salt for preparing an electrolyte, there can be used at least one member selected from the group consisting of hydrochlorides, sulfates, nitrates and phosphates of alkali metals such as Na, K, etc. Among them, the use of $Na_2SO_4$ particularly in a saturated concentration (about 20% by weight) and NaCl particularly in a saturated concentration (about 10 to 20% by weight) is particularly preferable. Further, sulfates and chlorides are more preferable due to high reactivity for surface metals such as oxide film.

The radioactive contaminants removed by this treatment are left in the electrolyte, but in a neutral salt solution, all of such contaminants precipitate in the form of hydroxides or oxides and therefore the solution is not contaminanted at all by radioactivity.

According to the alternating electrolysis process of this invention, the dissolution of base metal and the separation of oxide films progress simultaneously, and the separated oxide films settle down without dissolved in the electrolyte while the metal ions eluted collateral with the dissolution of base metal are reacted, in the manner shown by the following formula (4), with the hydroxide ions produced from the reactions of the formulae (1) and (2) shown before.

$$Fe_3^{3+} + 3OH^- \rightarrow Fe(OH)_3 \quad (4)$$

Also, as noted from the reaction formulae (1)–(4), water alone is consumed in the electrolysis reactions and no neutral salt is consumed, so that the electrolyte can be used continuously by merely supplying water.

The mixture of precipitated oxides and hydroxides is a sludge with a water content of 85–90%, so that it is desirable to concentrate such sludge by a suitable means such as centrifugal separation for the purpose of volume reduction. In a test where centrifugal dewatering was conducted at a speed of 4,000 r.p.m., the water content was reduced to 80–83% while the sludge volume was decreased to about ¼ of its original volume. Direct packaging of the sludge dewatered to a water content of 80–83% in a drum is attended by such problems as corrosion of the drum and leakage of radioactivity, so that the sludge needs be solidified by some suitable means.

There are known several means for solidifying the radioactive waste, such as binding with plastic, binding with asphalt and binding with cement. But considering decay, cracking, harmony with underground soil and other matters experienced in long-time preservation, it is advised to solidify the waste by using an inorganic material such as cement rather than using an organic material.

Figure 4:
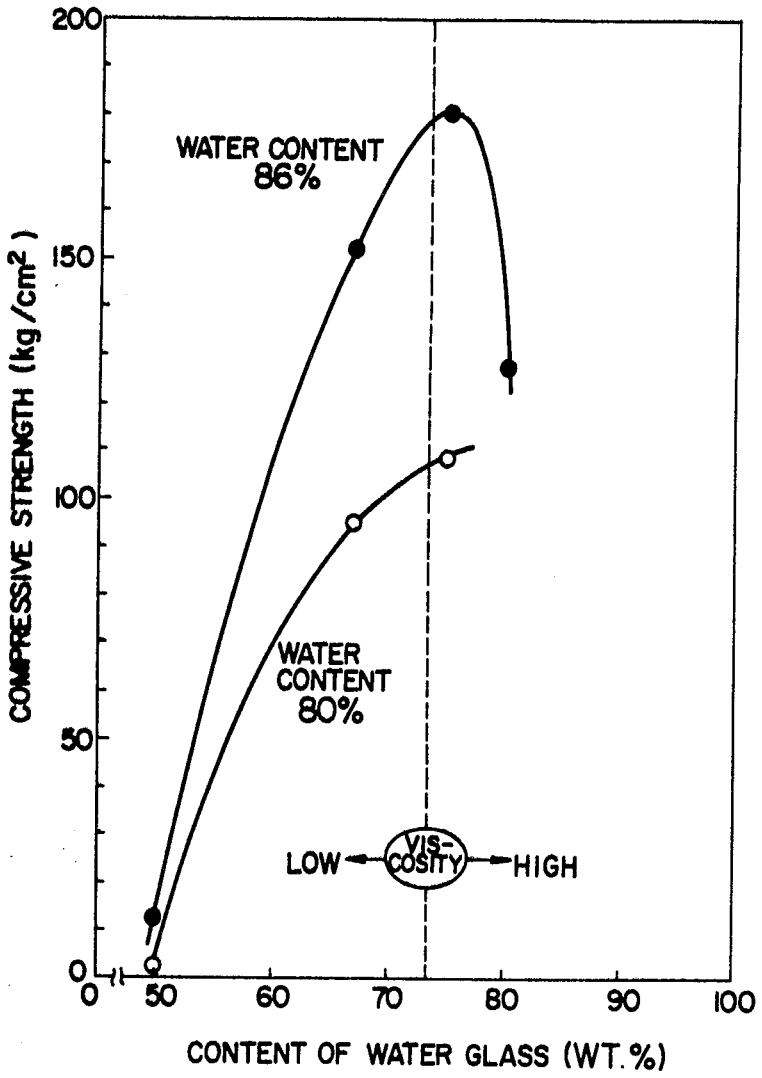
FIG. 4 is a graph showing the relation between a water glass content in dehydrated sludge and compressive strength.

In the method of this invention, the residue is solidified by using a solidifying agent, but it is especially preferred to solidify the dewatered sludge with water glass. In case of using water glass as solidifying agent, it suffices to simply mix water glass and dewatered sludge, and there is no need of adding other additives or conducting extra treatment such as heating. The strength of the solidified mass made by this method is of course decided by the mixing ratio of water glass to dewatered sludge. FIG. 4 shows the compressive strength of the solidified masses formed by mixing dewatered sludge (80% water content) and pre-dewatered sludge (86% water content), respectively, with water glass. It is seen from the graph that in the case of pre-dewatered sludge, the strength is maximized when the water glass content is 72–73% by weight, while in the case of dewatered sludge, the strength reaches a substantially constant maximal level when the water glass content is 72–73% by weight. These dictate that the mixing ratio by weight of sludge to water glass (powder) within the range of 1:2 to 1:3 is most desirable for obtaining the maximal strength of the solidified mass (no matter whether the sludge has been dewatered or not). The volume of the thus formed solidified mass is increased only about 1.1–1.2 times over that of the sludge before solidification, that is, before mixing with water glass, and thus this method is very advantageous for realizing the volume reduction of the waste.

EXAMPLE 1

Figure 5:
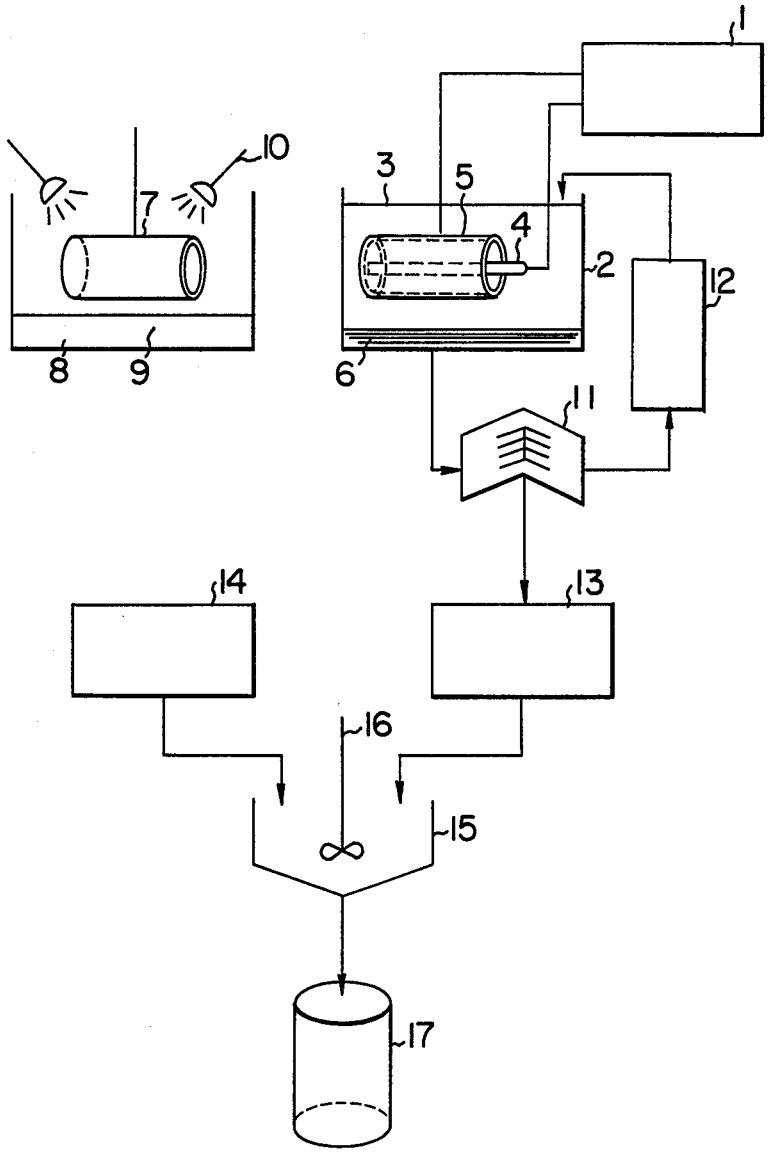
FIG. 5 is a schematic layout of an electrolytic decontamination system in an embodiment of this invention.

FIG. 5 is a schematic layout of an apparatus which is suited for practising the method of this invention. This apparatus comprises as its main constituents a power source 1, an electrolytic cell 2, a counter electrode 4, a washing tank 8, a centrifugal dehydrator 11, and a mixing tank 15. The radioactive waste 5 is immersed in the electrolytic cell 2 filled with a neutral salt solution 3 and subjected to alternating electrolysis with the counter electrode 4. The electrolysis time is preferably 10 to 20 minutes. The contaminants removed by the alternating electrolysis settle down as oxides or hydroxides 6, and the sediment is sent into the centrifugal dehydrator 11 where it is dewatered to a water content of about 80% to form a sludge 13, the latter being forwarded into the mixer 15. The liquid produced by the dewatering is passed through a filter 12 and reused as the electrolyte. The dewatered sludge in the mixer is stirred and mixed with 2 to 3 times the amout (by weight) of water glass 14 by a stirrer 16 and then packaged in a drum 17. The sludge and water glass mixture in the drum is solidified in 48–72 hours. The waste material decontaminated by the electrolysis is washed with ordinary tap water 9 by a spray washer 10 in the washing tank 8, whereby the intensity of its radioactivity can be reduced to the background level.

When the alternating electrolysis (repetition of 3-minute cathode electrolysis and one-minute anode electrolysis) was carried out for about 20 minutes by using the above-described apparatus while using a 20% by weight aqueous solution of sodium sulfate as electrolyte and carbon as counter electrode at a voltage of $\pm 5$ V and a current density of 0.5 A/cm$^2$, the contaminated oxide films could be perfectly removed. Further, when the sediment was dewatered by a 4,000 r.p.m. centrifugal separator and then mixed and solidified with 2 times the amount (by weight) of water glass, the volume could be reduced to about 1/15 of that of the waste 5 before the decontamination.

EXAMPLE 2

By using the same apparatus as in Example 1, the alternating electrolysis (repetition of 90-second cathode electrolysis and 30-second anode electrolysis) was conducted for about 10 minutes by using a 10% by weight aqueous solution of sodium chloride as electrolyte and carbon or steel as counter electrode at a voltage of $\pm 7$ V and a current density of 1 A/cm$^2$. The contaminated oxide films could be completely removed by this treatment. Also, the sediment was treated in the same way as in Example 1 to obtain a volume reduction of 1/15, which is the same as in Example 1.

EXAMPLE 3

By using the same apparatus as in Example 1 and by using a 20% by weight aqueous solution of sodium sulfate as electrolyte while letting the radioactive waste 5 serve as one electrode and the contaminated metal as counter electrode 4, the alternating electrolysis (repetition of 3-minute cathode electrolysis and one-minute anode electrolysis) was performed at a voltage of 5–10 V and a current density of 0.2–0.5 A/cm$^2$ for about 20 minutes. This treatment could perfectly remove the radioactivated oxide films. The sediment treatment in the manner as in Example 1 provided a volume reduction of 1/15 which is the same as in Example 1. According to this example, since the counter electrode 4 is constituted by a radiation contaminated metal product, it is possible to decontaminate two pieces of radiation contaminated metal products at one time.

As described above, according to the decontamination method of this invention, the radiation contaminated metals are subjected to the alternating electrolysis in an aqueous solution of a neutral salt for electrolytically removing the radioactivated oxide films on the metal surfaces. This treatment is capable of perfectly removing said oxide films from the base metal, making it possible to greatly reduce the radiation contaminated metal components in the nuclear plants. It is especially noteworthy that the method of this invention is capable of effectively removing even stiff spinel type radioactivated oxide films on the base metal. Also, according to the method of this invention, it is possible to minimize the rate of dissolution of the non-contaminated base metal in the electrolytic decontamination process, and this enables a marked reduction of secondary waste. Further, because of use of the neutral salt solution as electrolyte, both the electrolytic decontamination step and the step of removing the resultantly produced hydroxides, etc., can be accomplished at the same time, so that it is possible to realize a shortening of the electrolysis treatment time as well as cost reduction of the chemicals used for the electrolyte.

Moreover, according to the method of this invention, the oxides or hydroxides removed by the electrolysis can be separated from the electrolyte and solidified, so that their storage is easy.

What is claimed is:

1. A method for electrolytically decontaminating metals which have been contaminated on their surfaces with radioactive substances, which comprises subjecting a metal to be decontaminated to an alternating electrolysis treatment consisting of alternately repeated cathode electrolysis in a unit period of 30 to 180 seconds and anode electrolysis in a unit period of 15 to 60 seconds with a ratio of the cathode electrolysis time to the anode electrolysis time of 1 to 4 by using an aqueous solution of a neutral salt as electrolyte, thereby removing the radioactivated oxide films and metal surfaces.

2. A method according to claim 1, wherein the cathode electrolysis in a unit period is 60 to 90 seconds, the anode electrolysis in a unit period is 30 seconds and the ratio of the former to the latter is 2 to 3.

3. A method according to claim 1, wherein the total time of alternating electrolysis treatment is 10 to 20 minutes.

4. A method according to claim 1, wherein the neutral salt is at least one salt selected from the group consisting of hydrochlorides, sulfates, nitrates and phosphates.

5. A method according to claim 4, wherein the neutral salt is $Na_2SO_4$or NaCl.

6. A method for electrolytically decontaminating metals which have been contaminated on their surfaces with radioactive substances, which comprises subjecting a metal to be decontaminated to an alternating electrolysis treatment consisting of alternately repeated cathode electrolysis in a unit period of 30 to 180 seconds and anode electrolysis in a unit period of 15 to 60 seconds with a ratio of the cathode electrolysis time to the anode electrolysis time of 1 to 4 by using an aqueous solution of a neutral salt to thereby remove the radioactivated oxide films and metal surfaces, separating a decontamination residue contained in the electrolyte from the electrolyte, and solidifying the separated residue by adding a solidifying agent thereto.

7. A method according to claim 6, wherein the cathode electrolysis in a unit period is 60 to 90 seconds, the anode electrolysis in a unit period is 30 seconds and the ratio of the former to the latter is 2 to 3.

8. A method according to claim 6, wherein the total time of alternating electrolysis treatment is 10 to 20 minutes.

9. A method according to claim 6, wherein the neutral salt is at least one salt selected from the group consisting of hydrochlorides, sulfates, nitrates and phosphates.

10. A method according to claim 9, wherein the neutral salt is $Na_2SO_4$ or NaCl.

11. A method according to claim 6, wherein in the steps of separating and solidifying the decontamination residue, said residue is first concentrated by dewatering and then mixed with water glass for solidification.

12. A method according to claim 11, wherein the concentration by dewatering of said decontamination residue is conducted by a centrifugal separation method.

13. A method according to claim 11, wherein the mixing ratio of decontamination residue to water glass is 1:2–1:3.

* * * * *